US006102389A

United States Patent [19]

Sakurai et al.

[11] Patent Number: 6,102,389

[45] **Date of Patent: *Aug. 15, 2000**

[54] SHEET FEEDING DEVICE

[75] Inventors: Kenji Sakurai, Tokyo; Katsuo Nakayama, Yokohama; Mitsuhiro Mukasa, Kawasaki, all of Japan

[73] Assignee: Canon Aptex Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/960,450

[22] Filed: Oct. 29, 1997

[30] Foreign Application Priority Data

Nov. 1, 1996 [JP] Japan ..... 8-292159
Dec. 27, 1996 [JP] Japan ..... 8-350676

[51] Int. Cl.[7] ..... B65H 3/52; B65H 1/16; B65H 3/34

[52] U.S. Cl. ..... 271/121; 271/125; 271/155; 271/167

[58] Field of Search ..... 271/121, 122, 271/125, 152, 154, 155, 167

[56] References Cited

U.S. PATENT DOCUMENTS 4,887,806 12/1989 Tanaka et al. ..... 272/121
5,044,622 9/1991 Cattin ..... 271/121
5,058,877 10/1991 Fujiwara et al. ..... 271/124
5,137,265 8/1992 Sato et al. .
5,298,959 3/1994 Saito et al. .
5,335,902 8/1994 Suzuki ..... 271/121
5,350,168 9/1994 Sheridan ..... 271/122
5,443,251 8/1995 Kan et al. ..... 271/16
5,857,671 1/1999 Kato et al. ..... 271/10.11

FOREIGN PATENT DOCUMENTS 403128830 5/1991 Japan ..... 271/121

*Primary Examiner*—Christopher P. Ellis
*Assistant Examiner*—Kenneth W Bower
*Attorney, Agent, or Firm*—Fitzpatrick, Cella, Harper & Scinto

[57] ABSTRACT

A sheet feeding device is provided with a sheet feeding unit for feeding sheets supported on a sheet support means, and sheet separator means provided downstream of the sheet feeding unit with respect to the sheet feeding direction, the sheets fed by the sheet feeding unit being separated one by one by the sheet separator and fed. The sheet separator is comprised of an inclined surface against which the sheet fed by the sheet feeding unit abuts, a dash member provided downstream of the inclined surface with respect to the sheet feeding direction and against which the leading end of the sheet riding over the inclined surface abuts, and a resilient member for displaceably supporting the dash member when the sheet abuts against the dash member.

13 Claims, 9 Drawing Sheets

SHEET FEEDING DEVICE

BACKGROUND OF THE INVENTION

1. Field of the Invention

This invention relates to a sheet feeding device and an image forming apparatus provided with the same, and particularly to a sheet feeding device capable of reliably separating sheets and feeding them to a sheet conveying device.

2. Related Background Art

As a sheet feeding device for use in an image forming apparatus for forming an image on a recording medium (sheet), use is made of a separating pad type which is provided with a high friction member downstream of sheet feeding means in the direction of conveyance and in which a sheet feeding roller is made to bear against the high friction member to thereby separate sheets set on a sheet feeding bed one by one and convey them.

However, such a prior-art sheet feeding device and an image forming apparatus provided with the same are of a construction in which the bearing force of the high friction member is strong to prevent a "multiplex feeding phenomenon" in which two or more sheets are fed at a time. This has led to the problem that a foreign substance such as oil content contained in rubber is transferred to a sheet held between a sheet feeding roller and the high friction member to thereby spoil an image formed thereafter.

SUMMARY OF THE INVENTION

So, the present invention has been made in order to solve such a problem and the object thereof is to provide a sheet feeding device capable of reliably separating sheets and conveying them without any foreign substance being transferred to the sheets, and an image forming apparatus provided with the same.

The present invention is a sheet feeding device provided with sheet feeding means for feeding sheets supported on sheet supporting means, and sheet separating means provided downstream of the sheet feeding means with respect to the sheet feeding direction, the sheets fed by the sheet feeding means being separated one by one by the sheet separating means and fed, wherein the sheet separating means is comprised of:

- an inclined surface against which the sheet fed by the sheet feeding means strikes;
- a dash member provided downstream of the inclined surface with respect to the sheet feeding direction and against which the leading end of the sheet having cleared the inclined surface bears; and
- a resilient member for displaceably supporting the dash member when the sheet strikes against the dash member.

DESCRIPTION OF THE PREFERRED EMBODIMENT

An embodiment of the present invention will hereinafter be described with reference to the drawings.

Figure 1:
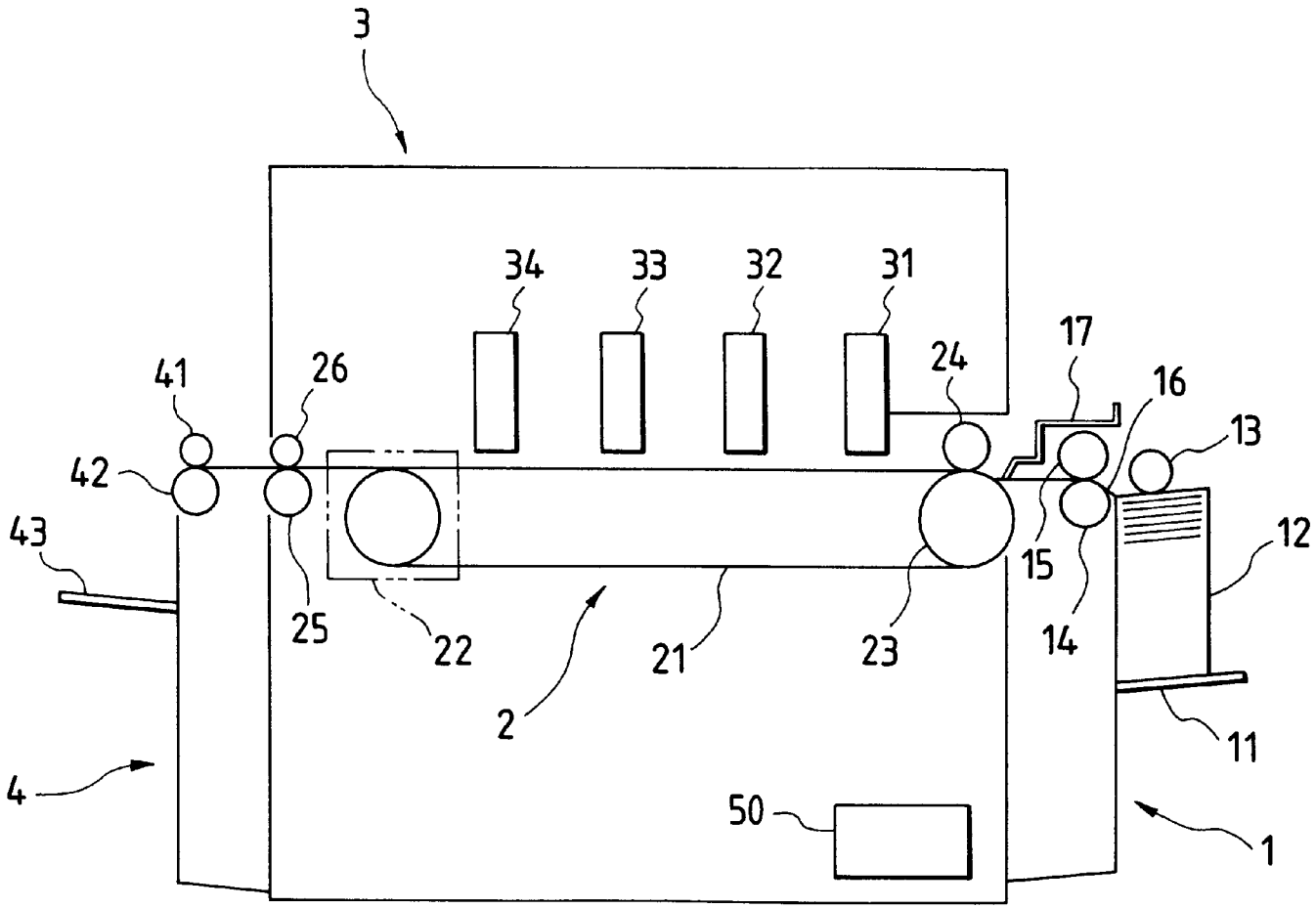
FIG. 1 is a cross-sectional view of a full color ink jet printer provided with a sheet feeding device according to an embodiment of the present invention.

Referring to FIG. 1 which is a cross-sectional view of a full color ink jet printer which is an image forming apparatus provided with a sheet feeding device according to an embodiment of the present invention, the ink jet printer is provided with a sheet feeding device 1, a sheet conveying device 2, an ink jet head portion 3 which is an image forming portion, and a stacker 4.

The sheet feeding device 1 is for supplying a sheet to the ink jet head portion 3 through the sheet conveying device 2, and is comprised of a tray 11 which is a sheet supplying bed on which sheets 12 are set, a pick-up roller 13 which is a sheet feeding roller for feeding the set sheets 12, conveying rollers 14 and 15 for conveying the sheet 12 fed by the pick-up roller to the sheet conveying device 2, a separating guide 16 for preventing the multiplex feeding of the sheets 12 and constituting sheet separating means which will be described later, and a shutter 17 for correcting the oblique movement of the sheets 12.

The bearing force of the pick-up roller 13 against the sheets 12 is such a degree of light force that can reliably convey a sheet 12, whereby the transfer of a foreign substance such as oil content emitted from the pick-up roller 13 to the sheets can be prevented.

Also, the sheet conveying device 2 is for supplying the sheets 12 to the ink jet head portion 3 and directing the sheets to the exit of the printer, and is comprised of a conveying belt 21 for conveying the sheets 12, a stepping motor 22 for driving the conveying belt 21, guide rollers 23 and 24 for directing the sheets 12 to the conveying belt 21, and sheets discharging rollers 25 and 26 for directing the sheets 12 to the exit of the printer. The stepping motor 22 also provides a drive source for the guide rollers 23, 24 and the sheet discharging rollers 25, 26.

Further, the ink jet head portion 3 is for forming an image on the sheet 12 conveyed thereto, and is comprised of ink jet heads 31, 32, 33, 34 of four colors (black, cyan, magenta and yellow) for full color image formation.

Also, the stacker 4 is for stocking the sheets on which images have been formed, and is comprised of sheet discharging rollers 41 and 42 for directing the sheets 12 to a sheet discharge tray 43, and the sheet discharge tray 43 for stocking the discharge sheets 12 thereon.

The process of the full color ink jet printer of such construction from image formation to sheet discharge will now be briefly described with reference to FIG. 1.

The sheet 12 directed from the sheet feeding device 1 to the sheet conveying device 2 is directed onto the conveying belt 21 by the guide rollers 23 and 24, whereafter it passes the underside of the ink jet heads 31, 32, 33 and 34 by the conveying belt 21 driven by the stepping motor 22, and during this passage, an image is formed on the sheet 12 by ink discharged. Subsequently, the sheet 12 on which the image has been thus formed is directed to the sheet discharging rollers 25 and 26 by the conveying belt 21, whereafter it is directed to the sheet discharge tray 43 by the sheet discharging rollers 41 and 42 and is stacked on the sheet discharge tray.

Figure 2:
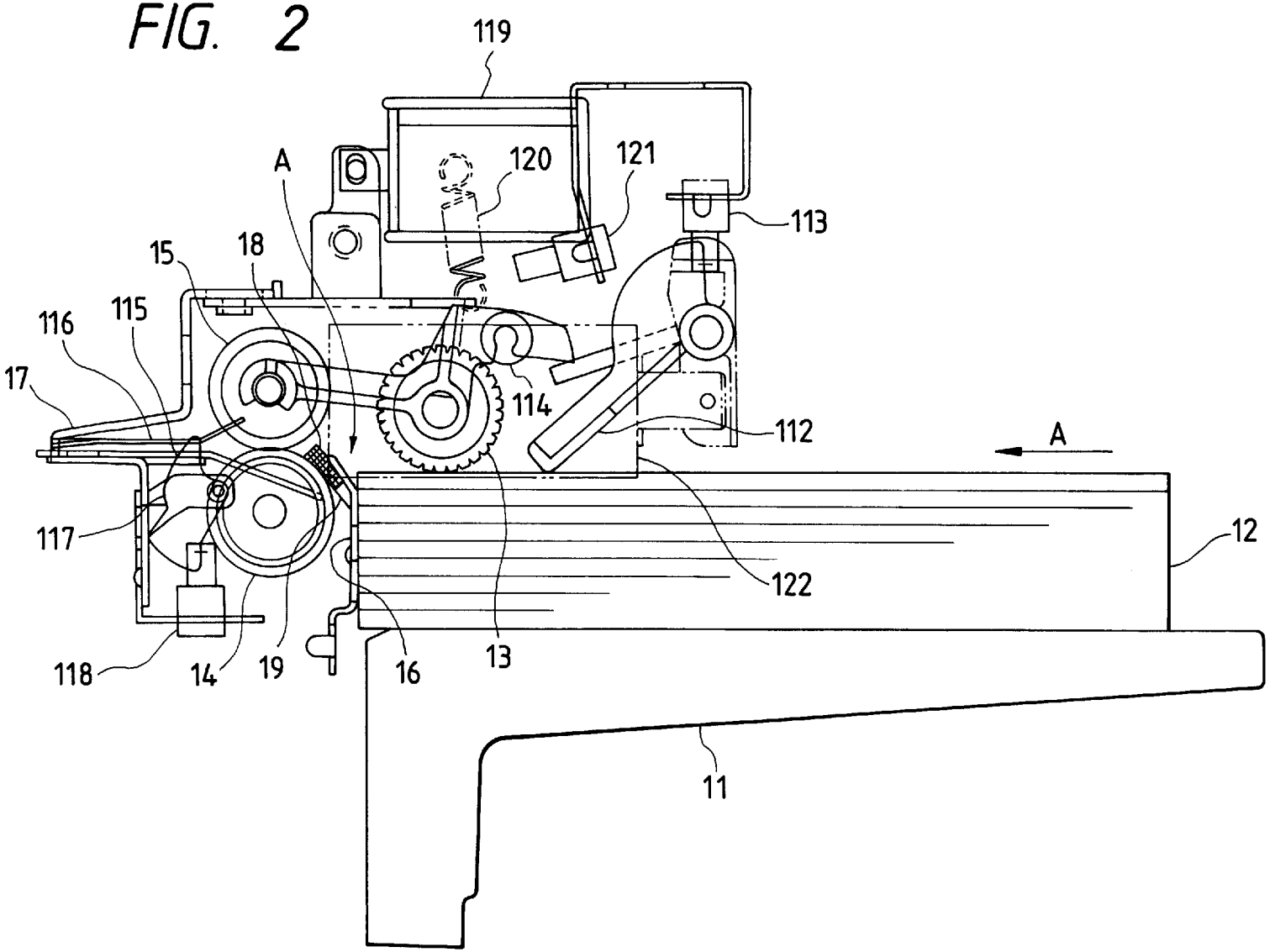
FIG. 2 is a longitudinal cross-sectional view of the sheet feeding device.

Now, the sheet feeding device 1, as shown in FIG. 2, is provided with the tray 11, the pick-up roller 13, the conveying rollers 14, 15, the separating guide 16 and the shutter 17, and is further provided with a paper surface detecting lever 112, a paper surface detecting photointerrupter 113, a pick-up roller weight 114, a lower guide 115, a narrow guide 116, a paper detecting lever 117, a paper detecting photointerrupter 118, a shutter solenoid 119, a shutter spring 120, an upper limit detecting photointerrupter 121 and a pick-up solenoid 122.

The sheet feeding operation will hereinafter be described with reference to the flow chart of FIG. 9. The tray 11 has a plurality of sheets 12 piled thereon, and is lifted and lowered by a tray motor and a lift mechanism (not shown). The tray 11 is lifted by a lifting command (S1), and the uppermost one 12 of the sheets 12 is disposed at a predetermined feeding position, and pushes up the paper surface detecting lever 112, and stops being lifted when the paper surface detecting photointerrupter 113 is turned off (S2 and S3, the details of which will be described later). When a print executing command is given from an operation panel (not shown) (S5), the pick-up roller 13 is lifted upwardly as viewed in FIG. 2 by the pick-up solenoid 122 (S11), whereafter it is driven by a conveying motor (not shown) through the conveying rollers 14 and 15, and falls from gravity while being rotated clockwisely, and directs the sheet 12 leftwardly as viewed in FIG. 2.

The pick-up roller 13 is rotated for a predetermined time, whereafter it is again lifted by the pick-up solenoid 122 and stops rotating and waits. The sheets 12 are separated one by one by passing the separating guide 16 and the separating pad 18, and are sent to the conveying rollers 14 and 15. The conveying rollers 14 and 15 are rotated counter-clockwisely and clockwisely, respectively, by a conveying motor (not shown) and a gear (not shown) connected thereto, to thereby feed the sheet 12 to between the narrow guide 116 and the lower guide 115, and rotate the paper detecting lever 117 counter-clockwisely as viewed in FIG. 2, thus causing the paper detecting photointerrupter to detect the presence of the sheet (S212). The sheet 12 is further moved leftwardly as for a predetermined time, whereby its skew feed is corrected, whereafter the shutter 17 is rotated clockwisely as viewed in FIG. 2 by the shutter solenoid 119 (S14), and the sheet is fed to the conveying belt 21 of the sheet conveying device 2 by the rotation of the conveying rollers 14 and 15. The shutter 17 keeps opened for a predetermined time by the shutter solenoid 119, whereafter it is returned to the state of FIG. 2.

When the sheet 12 is fed to the sheet conveying device 2, the paper detecting photointerrupter 118 detects the absence of the sheet (S13), and shift is made to B, where the pick-up roller 13 is lowered while being again rotated (S11), thereby feeding the sheet 12 to the left as viewed in FIG. 2. By these series of operations, the sheet 12 is directed leftwardly as viewed in FIG. 2 and the operation of feeding the sheet to the sheet conveying device 2 is repeated, whereby the sheets on the tray 11 are successively fed.

Figure 9:
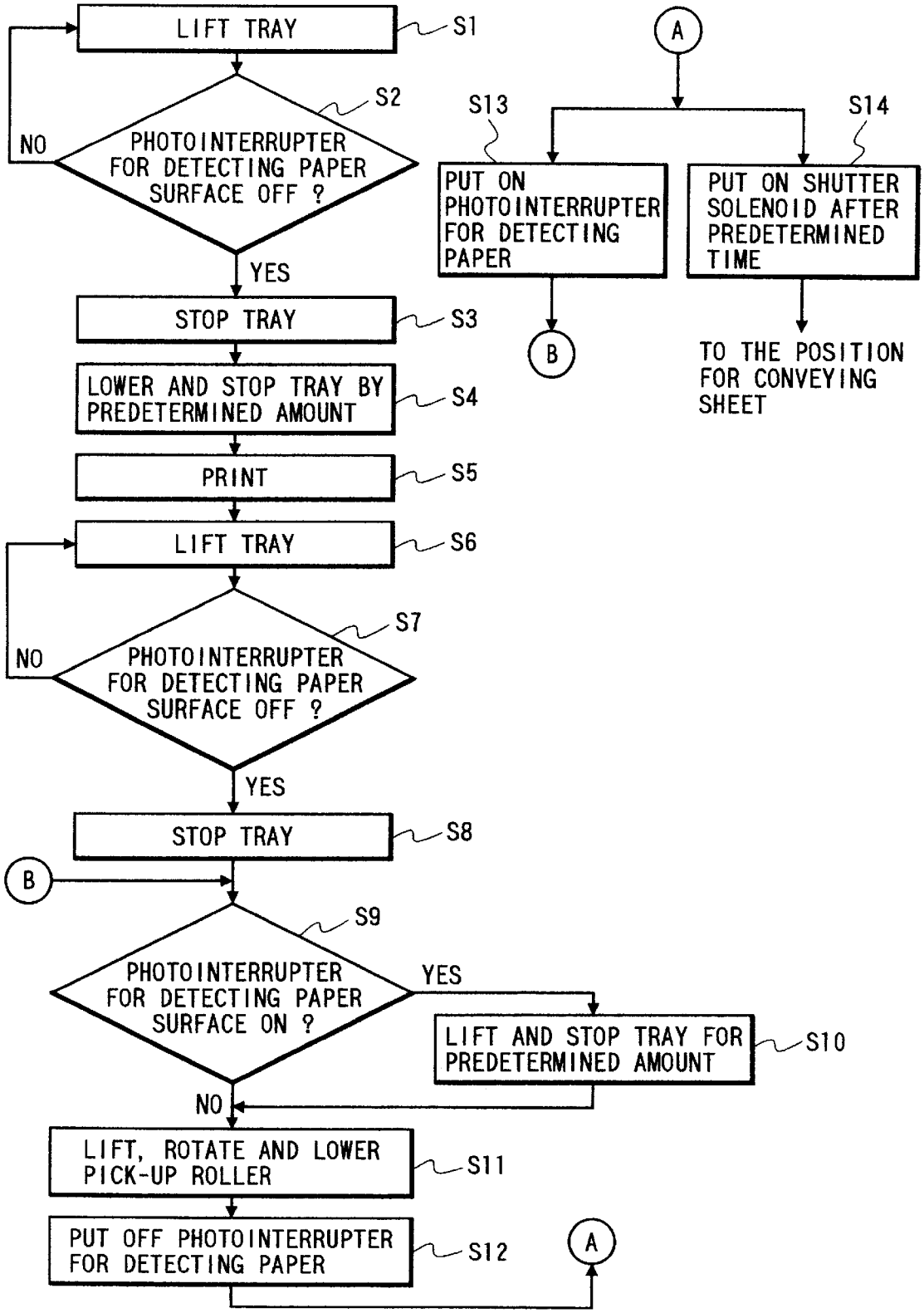
FIG. 9 is a flow chart of the sheet feeding operation.

In the foregoing description of the flow chart of FIG. 9, the characteristic steps in the present invention are excluded. These will hereinafter be described.

Figure 3:
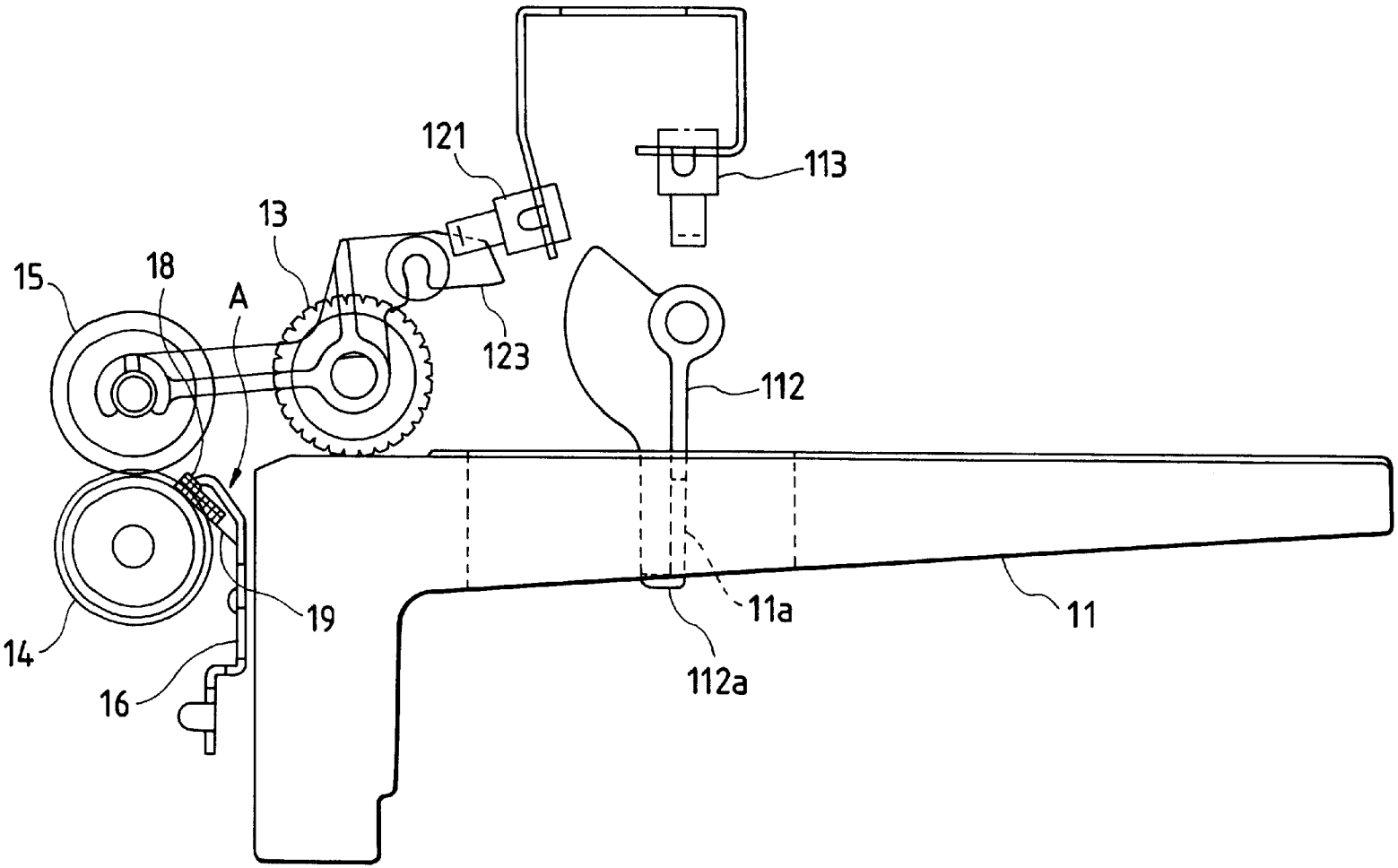
FIG. 3 is a longitudinal cross-sectional view showing a state in which there is no sheet on the tray of the sheet feeding device.

FIG. 3 shows a state in which there is not sheet 12 on the tray 11. The paper surface detecting lever 112 has its tip end portion 112*a* brought into a hole 11*a* formed in the tray 11, and the paper surface detecting photointerrupter 113 is turned on. Thereafter, when the tray 11 is lifted by a predetermined amount, the pick-up roller arm 123 turns off the upper limit photointerrupter 121, detects the absence of the sheet and gives off a message to a user through an operation panel (not shown).

When the uppermost one 12 of the sheets 12 pushes up the paper surface detecting lever 112 and the paper surface detecting photointerrupter 113 is turned off (S2), the pick-up roller 13 is in contact with the uppermost sheet 12, but irrespective of the presence or absence of a print executing command, the tray 11 is once lowered by a predetermined amount by a tray motor (not shown) being rotated and is stopped (S4), thus bringing the pick-up roller 13 out of contact with the uppermost sheet 12. When there is given the print executing command (S5), sheet supply is actually effected and the tray 11 is again lifted a predetermined time before (S6), and the uppermost sheet 12 is detected by the paper surface detecting lever 112 as previously described (S7), whereupon the tray 11 is stopped (S8). Thereby, the time of contact between the sheet 12 and the pick-up roller 13 is controlled, that is, positively shortened to thereby prevent any foreign substance in the pick-up roller 13 from being transferred to the sheet 12. When thereafter, the paper surface detecting photointerrupter 113 is turned off, the tray 11 is lifted by a predetermined amount and stopped (S10), while the paper surface detecting photointerrupter 113 is turned on, the pick-up roller is lifted and lowered (S11), whereby the sheet 12 is fed. The operation thereafter is similar to what has been described above.

As other control, design may be made such that instead of detecting OFF by the paper surface detecting photointerrupter 113 (S2), and lowering the tray 11 by a predetermined amount and stopping it (S4), the pick-up roller 13 is lifted by the pick-up solenoid 122 to thereby maintain the pick-up roller 13 spaced apart from the uppermost sheet 12.

The pick-up roller 13 is kept lifted until the print command is given and the sheet 12 and the pick-up roller 13 can be controlled and thus, the transfer of any foreign substance to the sheet 12 can be prevented.

Further, in the above-described embodiment, if the conveying rollers 14 and 15 are designed to be rotated clockwisely and counter-clockwisely, respectively (in the opposite directions from those during the feeding) after the termination of the feeding, even when the paper surface detecting photointerrupter 113 detects the absence of the sheets and a sheet 12 remains in the sheet feeding device 1, that sheet 12 can be forcibly discharged to the tray 11 side. Thereby, the time for which the sheet 12 is in contact with the conveying rollers 14 and 15 to the sheet 12 can be prevented.

The above-described control of the feeding is performed by a control device 50 not shown in FIG. 1.

Figure 4:
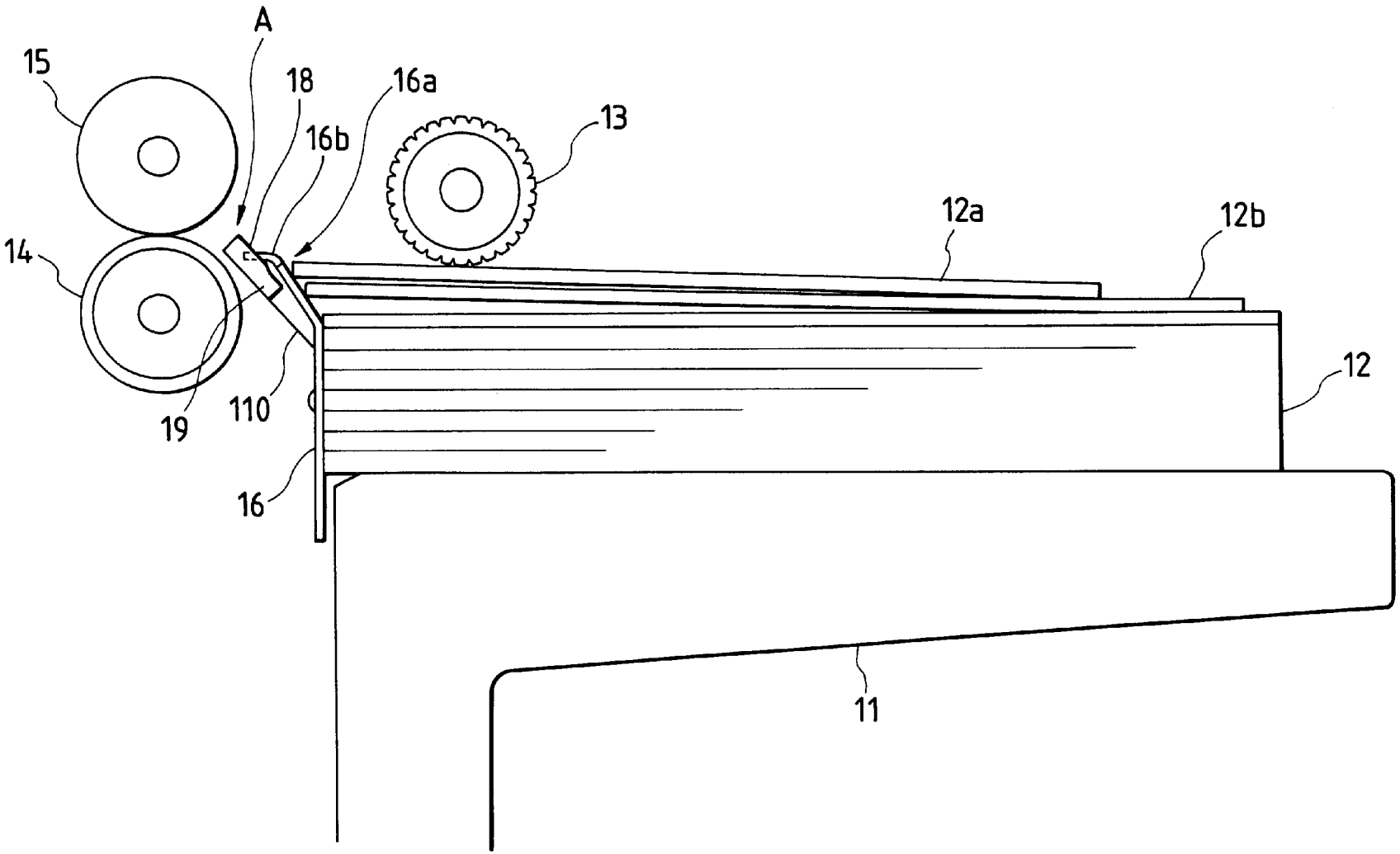
FIG. 4 shows the manner in which two sheets fed are separated from each other in the sheet feeding device.

In FIGS. 2 and 3, the letter A designates separating means comprised of a separating guide 16 having a separating inclined portion 16*a* which is an inclined surface shown in FIG. 4, and a high friction member 18 which is dash means provided downstream of the separating guide 16 with respect to the sheet feeding direction. The high friction member 18 is supported on the separating guide 16 through a resilient member 110 such as a leaf spring as shown, for example, in FIG. 4.

An elastic member 19 such as sponge is provided between the high friction member 18 and the resilient member 110. Also, sideways of the opposite side of the high friction member 18 from the separating guide 16, there is provided a stopper 111 which is stopper means for limiting the inclination of the high friction member 18 when as shown in FIG. 5, the high friction member 18 is pressed by the sheet 12 conveyed thereto and is inclined in a counter-clockwise direction.

The resilient force of the resilient member 110 is set to a value smaller than the conveying force of a sheet 12, and the high friction member 18 is designed such that the coefficient of friction between the high friction member 18 and the sheet 12 becomes greater than the coefficient of friction between the sheets 12 and the coefficient of friction between the separating inclined portion 16*a* and the sheet 12.

Figure 5:
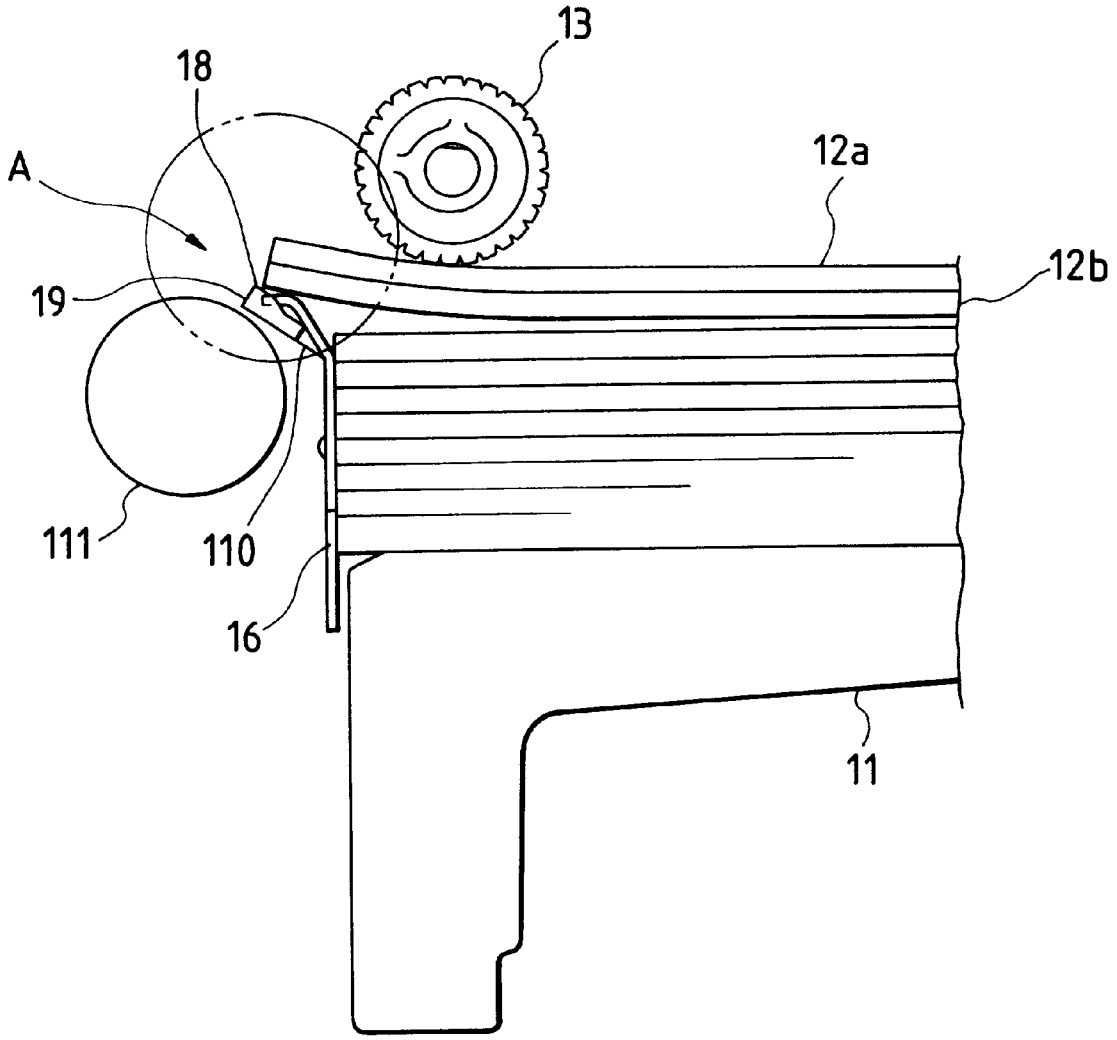
FIG. 5 shows the manner in which the high friction member of the sheet feeding device is pushed by a sheet fed thereto and bears against a stopper.
Figure 6:
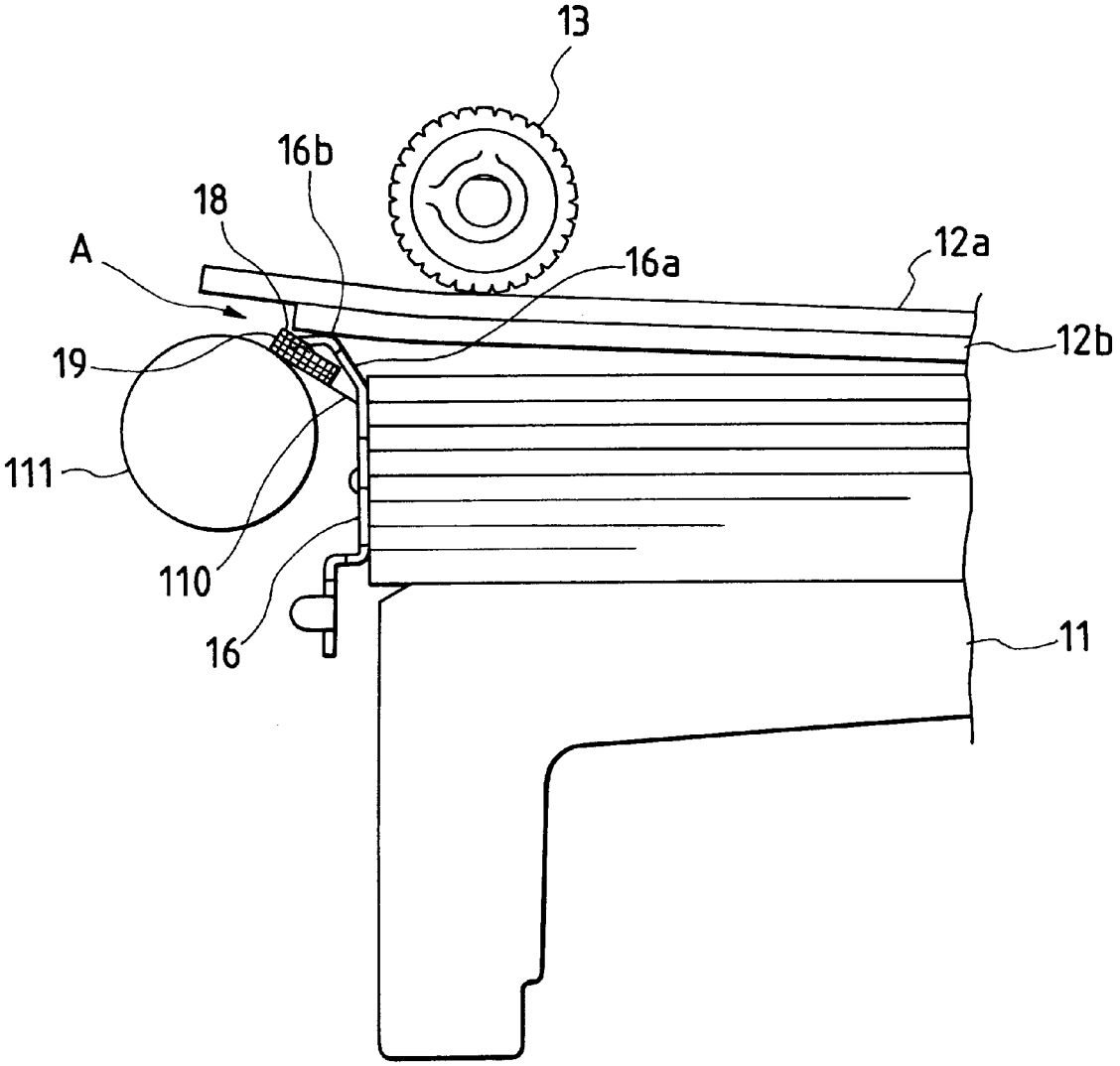
FIG. 6 shows the manner in which only the uppermost one of the two sheets is separated and conveyed.

Thus, when for example, the leading end of two sheets 12 which could not be separated from each other by the separating guide 16 arrives at the high friction member 18, the resilient member 110 is pressed by the sheets 12 and becomes inclined, whereafter it comes into contact with the stopper 111 as shown in FIG. 5, whereby the high friction member 18 becomes fixed. When in this state, the sheets 12*a* and 12*b* are further conveyed, the lower sheet 12*b* sliding on the high friction member 18 becomes stopped by the high friction member 18, and as shown in FIG. 6, only the uppermost sheet 12*a* is conveyed.

Figure 7:
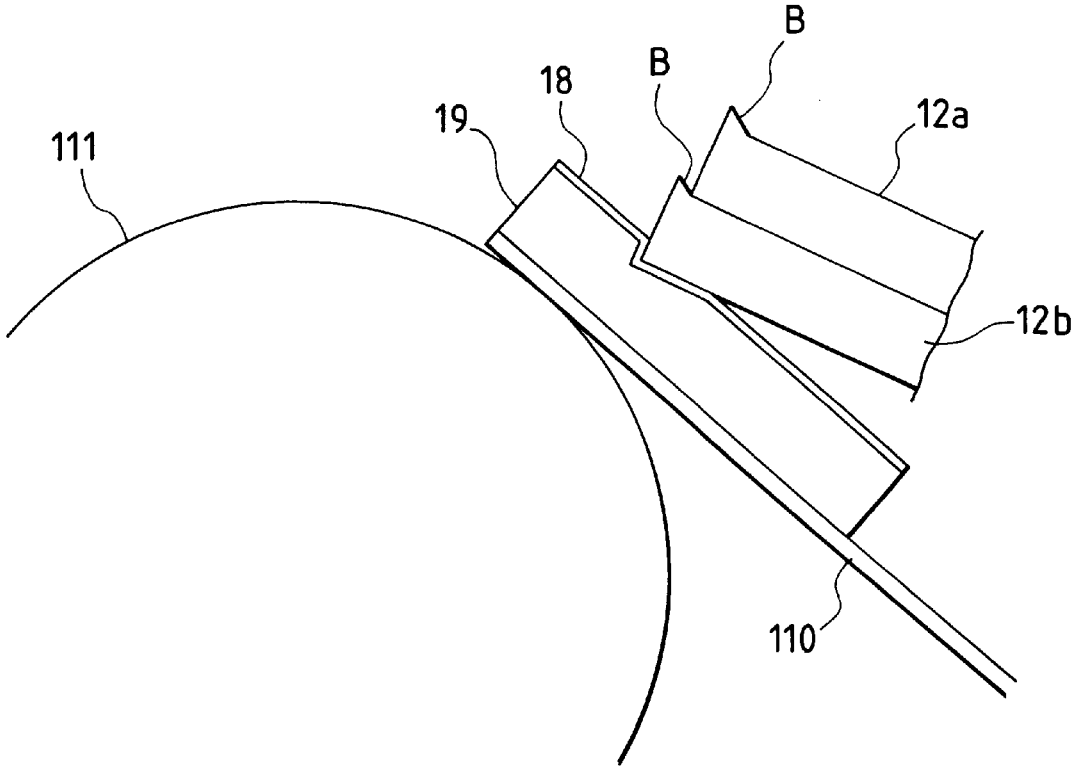
FIG. 7 shows the manner in which the leading end of the lower one of the two sheets conveyed eats into the high friction member and is stopped thereby.

In the present embodiment, as shown in FIG. 7, the leading end of the sheet 12 eats into the high friction member 18 with the aid of the elastic member 19, whereby the separating performance of the high friction member 18 can be enhanced. Also, at the separating guide 16, separation is effected with the separating inclined portion 16*a* being inclined at an angle of 60° and with the feeding position being spaced apart by 3 to 4 mm downwardly from the vertex 16*b* of the guide, but use may be made of other angles of inclination and other feeding positions.

The sheet separating operation of the thus constructed sheet separating means will now be described.

First, a print executing command is given from an operation panel, and a pick-up roller 13 falls while rotating clockwisely, whereby only the uppermost sheet 12*a* is conveyed to the guide inclined portion 16*a* of the separating guide 16 by the pick-up roller 13. The sheet 12*a* arrives at the high friction member 18 via the inclined portion 16*b* and is conveyed to the conveying rollers 14 and 15.

Figure 8:
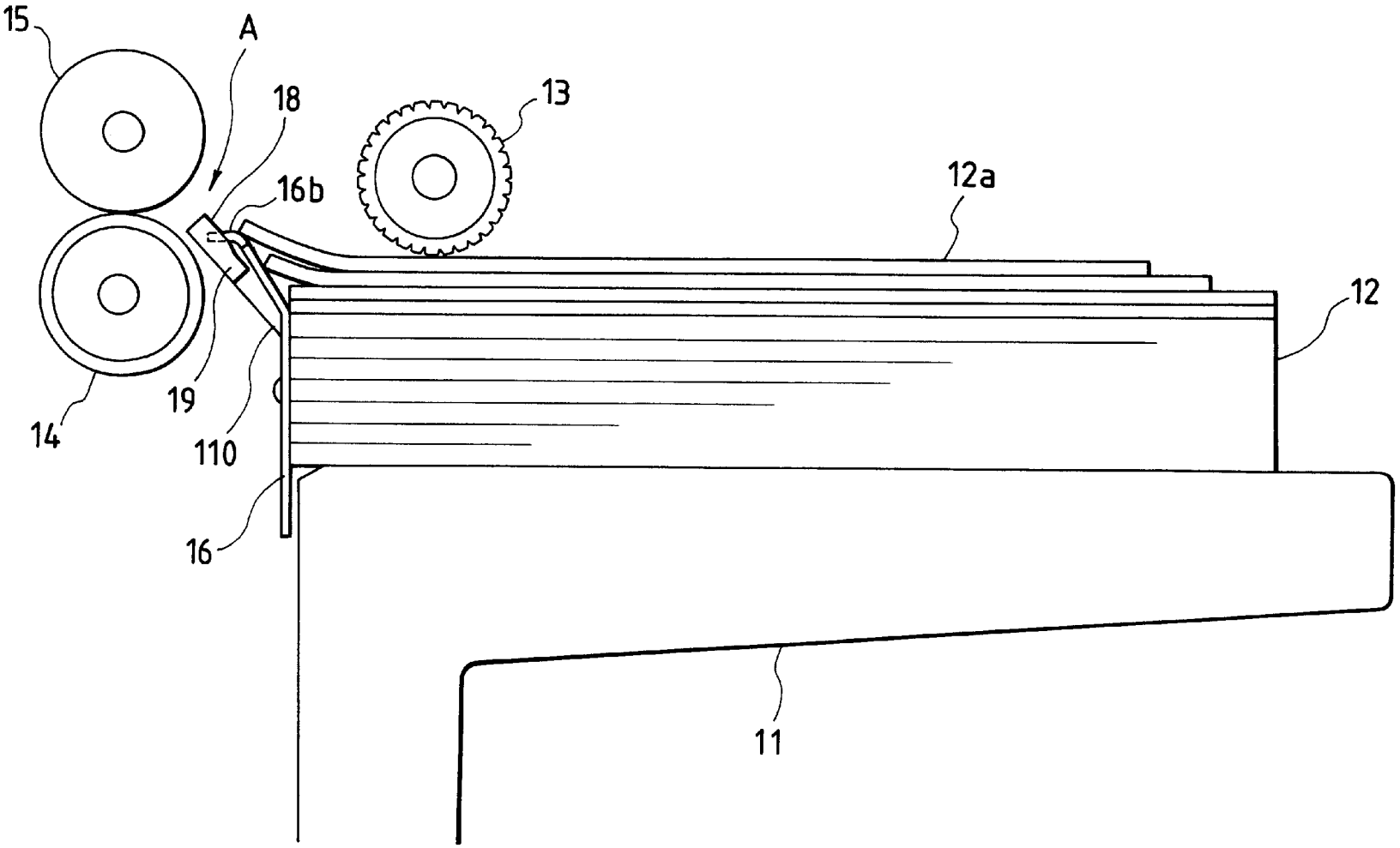
FIG. 8 shows the manner in which the uppermost one of the two sheets conveyed is separated by a separating guide and conveyed.

On the other hand, when two or more sheets are fed by the pick-up roller 13, the leading end of the uppermost sheet 12*a* bears against the guide inclined portion 16*a*, as shown in FIG. 4, whereby the uppermost sheet 12*a* is separated from the next sheet 12*b* and only the uppermost sheet 12*a* is conveyed. Also, as the uppermost sheet 12*a* is conveyed on the guide inclined portion 16*a*, the sheet 12*a* is curved as shown in FIG. 8 so as to ensure separation to be effected more reliably when the leading end of the sheet 12*a* arrives at the vertex 16*b* of the guide.

Now, when two or more sheets have been fed as described above, if there are created burs B in the end portions of the sheets due to cutting or the like, for example, two sheets 12*a* and 12*b* cannot be separated from each other by the separating guide 16 as shown in FIG. 5, and the leading ends of these inseparable sheets 12*a* and 12*b* arrive at the high friction member 18. The resilient member 110 is inclined by the sheets 12*a* and 12*b* thus conveyed thereto and bears against the stopper 111, whereby the high friction member 18 is fixed.

When the high friction member 18 is thus fixed, the leading end of the next one 12*b* of the two sheets 12*a* and 12*b* conveyed eats into the high friction member 18 with the aid of the elastic member 19 as shown in FIG. 7 and is stopped thereby, whereby as shown in FIG. 6, the uppermost sheet 12*a* is separated and only the uppermost sheet 12*a* is conveyed. The sheet 12*b* which has eaten into the high friction member and has been stopped thereby is pushed by the high friction member 18 returned to its original state by the repulsive force of the elastic member 19 when the pick-up roller 13 is stopped, whereby the eating of the sheet 12*b* into the high friction member is released.

As described above, the other sheet 12*b* than the uppermost sheet 12*a* of the sheets which have passed the separating guide 16 is stopped by the high friction member 18, whereby the sheets which cannot be separated by the separating guide 16 alone can be separated one by one.

What is claimed is:

1. A sheet feeding device provided with sheet feeding means for feeding sheets supported on sheet supporting means, and sheet separating means provided downstream of said sheet feeding means with respect to the sheet feeding direction, the sheets fed by said sheet feeding means being separated one by one by said sheet separating means and fed, wherein said sheet separating means comprises:

an inclined surface against which the sheet fed by said sheet feeding means abuts, for separating the sheet;

a dash member provided downstream of said inclined surface with respect to the sheet feeding direction and against which the leading end of the sheet riding over said inclined surface abuts; and wherein said dash member separates the sheet independent of a separating member;

a resilient member for displaceably supporting said dash member when the sheet abuts against said dash member; wherein said resilient member supports said dash member for angular displacement.

2. A sheet feeding device according to claim 1, wherein said resilient member supports said dash member in a state in which the surface thereof abutting against the sheet is inclined with respect to the sheet feeding direction.

3. A sheet feeding device according to claim 2, wherein said resilient member is a leaf spring.

4. A sheet feeding device according to claim 1, wherein said dash member is comprised of an elastically deformable elastic member.

5. A sheet feeding device according to claim 4, wherein a high friction member is disposed on that surface of said elastic member against which the sheet abuts.

6. A sheet feeding device according to claim 2, wherein the coefficient of friction of said high friction member is set so that the coefficient of friction between said high friction member and the sheet may be higher than the coefficient of friction between the sheets and the coefficient of friction between said inclined surface and the sheet.

7. A sheet feeding device according to one of claims 1 to 6, further comprising a stopper for limiting the displacement of said dash member.

8. An image forming apparatus provided with sheet feeding means for feeding sheets supported on sheet supporting means, sheet separating means provided downstream of said sheet feeding means with respect to the sheet feeding direction, and image forming means for forming images on the sheets, the sheets fed by said sheet feeding means being separated one by one by said sheet separating means and fed to said image forming means to thereby form images on the sheets, wherein said sheet separating means comprises:

an inclined surface against which the sheet fed out by said sheet feeding means abuts, for separating the sheet;

a dash member provided downstream of said inclined surface with respect to the sheet feeding direction and against which the leading end of the sheet riding over said inclined surface abuts, and wherein said dash member separates the sheet independent of a separating member; and a resilient member for displaceably supporting said dash member when the sheet abuts against said dash member, wherein said resilient member supports said dash member for angular displacement.

9. A sheet feeding device provided with sheet feeding means for feeding sheets supported on sheet supporting means in a sheet feeding direction, and sheet separating means provided downstream of said sheet feeding means with respect to the sheet feeding direction, the sheets fed by said sheet feeding means being separated one by one by said sheet separating means and fed, wherein said sheet separating means comprises:

an inclined surface against which the sheet fed by said sheet feeding means abuts, for separating the sheet; and abutment means disposed independent of a separating member and provided downstream of said inclined surface with respect to the sheet feeding direction, wherein said abutment means is angularly displaceably supported so that said abutment means displaces when the leading end of the sheet riding over said inclined surface abuts against said abutment means and said abutment means separates one by one the sheet unable to be separated by said inclined surface.

10. A sheet feeding device according to claim 9, further comprising a stepper for limiting the displacement of said abutment means.

11. A sheet feeding device according to claim 9, wherein said abutment means has a high friction member disposed on a position against which the sheet abuts.

12. A sheet feeding device according to claim 11, wherein a coefficient of friction of said high friction member is set so that a coefficient of friction between said high friction member and the sheet may be higher than a coefficient of friction between the sheets and a coefficient of friction between said inclined surfacemand the sheet.

13. An image forming apparatus provided with sheet feeding means for feeding sheets supported on sheet supporting means in a sheet feeding direction, sheet separating means provided downstream of said sheet feeding means with respect to the sheet feeding direction, and image forming means for forming images on the sheets, the sheets fed by said sheet feeding means being separated one by one by said sheet separating means and fed to said image forming means to thereby form images on the sheets, wherein said sheet separating means comprises:

an inclined surface against which the sheet fed by said sheet feeding means abuts, for separating the sheet; and abutment means disposed independent of a separating member and provided downstream of said inclined surface with respect to the sheet feeding direction, wherein said abutment means is angularly displaceably supported so that said abutment means displaces when the leading end of the sheet riding over said inclined surface abuts against said abutment means and said abutment means separates the sheet which could not separated by said inclined surface one by one.

* * * * *

UNITED STATES PATENT AND TRADEMARK OFFICE

CERTIFICATE OF CORRECTION

PATENT NO. : 6,102,389
DATED : August 15, 2000
INVENTOR(S) : Kenji Sakurai, et al.

It is certified that error appears in the above-identified patent and that said Letters Patent is hereby corrected as shown below:

Column 6:
Line 47, "claim 2," should read -- claim 5, --.

Column 8:
Line 9, "surfacemand" should read -- surface and --; and
Line 30, "separated" should read -- be separated --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*